US005870118A

United States Patent [19]

Günther et al.

[11] Patent Number: 5,870,118

[45] Date of Patent: *Feb. 9, 1999

[54] INK-JET PRINTER HEAD FORMED OF MULTIPLE INK-JET PRINTER MODULES

[75] Inventors: Stephan Günther; Ralf Kubatzki; Wolfgang Thiel; Junming Zhang, all of Berlin, Germany

[73] Assignee: Francotyp-Postalia AG & Co,, Birkenwerder, Germany

[ * ] Notice: The term of this patent shall not extend beyond the expiration date of Pat. No. 5,850,240.

[21] Appl. No.: 561,059

[22] Filed: Nov. 22, 1995

[30] Foreign Application Priority Data

Nov. 25, 1994 [DE] Germany ..... 44 43 244.5

[51] Int. Cl.[6] ..... B41J 2/14

[52] U.S. Cl. ..... 347/49; 347/68

[58] Field of Search ..... 347/49, 40, 42, 347/56, 68, 71, 70

[56] References Cited

U.S. PATENT DOCUMENTS

| | | | |
|---|---|---|---|
| 3,988,745 | 10/1976 | Sultan | 347/71 |
| 4,385,304 | 5/1983 | Sniderman . | |
| 4,392,145 | 7/1983 | Parkola . | |
| 4,605,939 | 8/1986 | Hubbard et al. . | |
| 4,703,333 | 10/1987 | Hubbard . | |
| 4,752,789 | 6/1988 | Maltsev . | |
| 5,148,194 | 9/1992 | Asai et al. . | |

FOREIGN PATENT DOCUMENTS

| | | | |
|---|---|---|---|
| 0 486 256 A2 | 5/1992 | European Pat. Off. . | |
| 0 615 844 | 9/1994 | European Pat. Off. . | |
| OS 38 05 279 | 8/1989 | Germany . | |
| OS 42 25 799 | 2/1994 | Germany . | |
| 63-37957 | 2/1988 | Japan | 347/40 |
| 5-269995 | 10/1993 | Japan | 347/68 |
| 2 264 086 | 8/1993 | United Kingdom . | |

*Primary Examiner*—Benjamin R. Fuller
*Assistant Examiner*—Judy Nguyen
*Attorney, Agent, or Firm*—Hill & Simpson

[57] ABSTRACT

An ink-jet printer head is composed of individual, stacked ink-jet printer modules operating according to the edge-shooter principle and equipped with plate-shaped piezoelectric actuators whose electrodes are contacted to leads of a ribbon conductor. The ink-jet printer head has a simplified structure and improved service properties and is composed of individual, identical ink-jet printer modules whose nozzle rows are arranged offset relative to one another and can be easily interchanged, because the carrier layer of the ribbon conductors enveloping the leads is reinforced and shaped in the region between neighboring ink-jet printer modules, so that the required spacing between the piezoactuators and between the nozzle rows of the ink-jet printer modules as well as an exact fixing thereof relative to one another are achieved. In this way, the ribbon conductors serve as a contact element, a spacer and an adjustment member for neighboring ink-jet printer modules. Complicated housing and front masks are thus eliminated and the number of components is reduced and adjustment outlay is largely avoided. The ink-jet printer head is provided for use in small, fast printers, wherein a large number of nozzles are required.

42 Claims, 5 Drawing Sheets

INK-JET PRINTER HEAD FORMED OF MULTIPLE INK-JET PRINTER MODULES

BACKGROUND OF THE INVENTION

1. Field of the Invention

The present invention is directed to an arrangement for an ink-jet printer head that is composed of a number of stacked ink-jet printer modules the modules operating according to the edge-shooter principle and being equipped with plate-shaped piezoelectric actuators.

2. Description of the Prior Art

Ink-jet printer heads of the above type are employed in small, fast printers that are in turn a component of modern machines for franking postal matter or for printing addresses. Such a printer is also suitable as a product labeling means.

Differing from a standard office printer having line-by-line printing, the printing by such heads ensues as a one-time imprint, such as a Franking imprint in one pass of the item to be imprinted, such as postal matter. Corresponding to this significantly larger printing width—approximately one inch—, the number of ink nozzles to be arranged under one another, and thus the number of piezoactuators, in an ink-jet printer head of this type is substantially larger than is the case in ink-jet printer heads for office printers.

In order to satisfy modern requirements—imprints having word and image characters—for postage meter machines with good printing quality, printer resolutions of approximately 200 dpi (drops per inch) are required, which means ink-jet printer heads having the same number of nozzles and piezoactuators given a printing width of one inch.

If all nozzles were arranged in a single nozzle row, the spacing between two neighboring nozzles would be the print density dimension t. Given more than one ink-jet printer module, the print density dimension is derived from the quotient of the nozzle spacing of a module and the number of modules. Standard nozzle apertures lie between 40–50 $\mu$m in width. Given an imprint width of one inch and a resolution of 200 dpi, the adjustment errors must be kept below 10 $\mu$m.

Necessarily, such ink-jet printer heads are implemented in planar or stacked fashion, first for reasons of allowable dimensions and the packing density that can thus be achieved and, second, for reasons of an economical manufacture, as discussed in German 42 25 799. Surface resonators are usually utilized as piezoactuators, formed by a piezoelectric material, for example lead-zirconate-titanate (PZT), arranged between two metal electrodes. The carrier plate—which simultaneously serves as the membrane plate over the ink printer chambers—can be composed of glass, ceramic, plastic or metal for the piezoactuators.

The way the modules are arranged relative to one another in order to achieve a printing density of 200 dpi and the contacting of the piezoactuators are thus critical problems.

The aforementioned German OS 42 25 799 discloses an ink-jet printer head of the type initially described that is composed of a number of different modules, of which only a nozzle lying at the exterior carries a common nozzle row at its end face. All modules have ink printer chambers desirable by piezoactuators for ink ejection, these chamber being connected via respective channels to the allocated nozzles. The connecting channels from module to module necessarily proceed orthogonally relative to the printer chambers.

Spacer parts are arranged between the modules and have an ink delivery opening and ink passage openings as well as a recess for the piezoactuators. The spacer parts can be one part or two pieces and are composed of the same material as the piezoactuators.

Although the advantage of only a single nozzle row is significant, the technological outlay for manufacturing modules which differ from one another is still substantial.

Higher machines or molding precision is required for the connecting channels which proceed through a number of modules than is required for the ink printer chambers, and a more complicated adjustment procedure is also required. The connecting channels are of various lengths and thus require additional electronic control measures in order to equalize flow and pressure therein.

A piezoelectric ink-jet printer head having a monolithic piezoceramic body is also disclosed in German OS 38 05 279 having transducers arranged parallel side-by-side, each transducer including a planar, piezoelectric drive element, a pressure chamber, and ink channel and a nozzle. The pressure chambers, the ink channels and the nozzles are fashioned as cavities in the piezoceramic body. Each drive element has an outer electrode, an inner electrode and an active piezoceramic layer arranged between the electrodes. The drive elements are piezoelectrically separated from one another by incisions in the active piezoceramic layer. The inner electrodes of the transducers are electrically connected to one another. The electrical connection of the outer and the inner electrodes ensues via a terminal ribbon or, a ribbon conductor. One terminal goes to the inner electrodes connected to one another. The outer electrodes are separately contacted with terminals. The underside of the piezoceramic body and a side thereof lying opposite the nozzle front are secured on a retainer frame. An ink nozzle and the terminal ribbon are conducted through openings in the retainer frame. The nozzle row is inclined relative to the moving direction of the recording medium by means of a slanting integration of the retaining frame in a housing and consequently the print density of the ink-jet printer head is enhanced; also see United Kingdom application 2 264 086, FIG. 3, with respect thereto. A number of retainer frames or ink-jet printer heads can also be stacked above one another and introduced in common into a housing. If one desired to try to stagger the nozzle rows relative to one another, either the retainer frame would have to be differently adapted or the housing would have to have corresponding graduations. The technological outlay, including adjustment outlay, would thereby be substantial.

Lastly, U.S. Pat. No. 4,703,333 discloses an ink-jet printer head wherein a number of ink-jet printer modules operating according to the side-shooter principle are stacked inclined behind one another such that the nozzle region as well as the ink supply region are free. A receptacle frame having slanting steps is matched to this fish scale-like arrangement. In order to achieve the lateral offset of the nozzles relative to one another, the ink-jet printer modules are provided with oblong holes through which screws that engage into threaded holes of the steps are conducted. The modules must be adjusted with a template and then locked with the screws. The individual ink-jet printer module is composed of a nozzle plate, an ink channel plate, a pressure chamber plate, a membrane plate with piezoactuators and a cover plate having a recess for a ribbon conductor for contacting the piezoactuators. An ink delivery channel having two ink connection sockets is machined into the cover plate.

As may be seen from this known disclosure, the number of individual parts and the adjustment outlay are substantial. A cleaning and tightening station adapted to this ink-jet printer head has an extremely complicated structure due to the graduation.

SUMMARY OF THE INVENTION

An object of the invention is to provide an ink-jet printer head having a simplified structure, an increase in the range of employment and an improved serviceability.

It is a further object of the invention to provide an ink-jet printer head composed of individual, identical ink-jet printer modules having nozzle rows offset relative to one another wherein the ink-jet printer modules can be easily interchanged, the number of component parts is reduced, and adjustment outlay is largely avoided.

The above object is achieved in accordance with the principles of the present invention in an ink-jet printer head composed of a number of edge-shooter inkjet modules arranged in a stack, each module having a nozzle row and the respective nozzle rows being staggered from module-to-module and each module being equipped with plate-shaped piezoactuators for causing ink to be ejected from an ink chamber, the electrodes of the piezoactuators being connected to the leads of a ribbon conductor embedded in a carrier layer, the carrier of the ribbon conductor being reinforced and shaped in a region between neighboring modules so that it simultaneously serves as a spacer for setting the desired spacing between the neighboring modules and as an adjustment member for precisely fixing a lateral offset of the neighboring modules relative to each other to produce the desired staggering of the nozzle rows.

A number of advantages are achieved by the inventive ink-jet printer.

Since the ribbon conductor in the region between the ink-jet printer modules is inventively utilized as a contact element and as a spacer and as an adjustment member for the ink-jet printer modules, complicated housing structures and front masks can be eliminated.

It is also possible to fashion the ribbon layer of the ribbon conductor in the region between the ink-jet printer modules such that this ribbon layer acts only as an adjustment member or only as a spacer. This could be the case when modified ink-jet printer modules are utilized.

The tailoring of the ribbon conductor ends, including the equipping thereof with driver circuits for the piezoactuators and with a plug-type connector outside the region between the ink-jet printer modules, can be prefabricated at the ribbon conductor manufacturer in conformity with the desired specifications.

The offset of the nozzle rows for the purpose of achieving the desired printing density is achieved exclusively by the stop members of the ribbon layer of the ribbon conductors; the ink-jet printer modules can thus be completely identically constructed. For example, the offset t from module-to-module given three ink-jet printer modules amounts to one-third of the nozzle aperture spacing of one module. If the ribbon conductor is made to align with the preceding ink-jet printer module, the stop members facing toward the neighboring ink-jet printer module are offset further relative to a defined lateral edge of the ink-jet printer module by the printing density dimension t than are the allocated, adapted recesses in the neighboring ink-jet printer module in which the stop members are received.

Stop members directed opposite one another on the ribbon layer defining the offset of neighboring ink-jet printer modules are positioned offset relative to one another by the printing density dimension t, the stop members being spaced a distance perpendicular of the ribbon from the front edge so that a line extending through the stop members is parallel to the front edge. In this way, it becomes possible to employ the same printer modules for ink-jet printer heads having different numbers of nozzles or different numbers of ink-jet printer modules. The required offset is then realized exclusively by means of the offset of the stop members.

The depth of recesses for the stop members in the ink-jet printer modules extended to the nozzle level. The step members have end surfaces lying in these recesses. The spacing s between two nozzle levels is defined exclusively by the spacing of the end surfaces of stop members of a ribbon layer extending toward one another. The precision of the spacing of neighboring nozzle levels can be set by exact adherence to the end surface distance of these stop members.

The ribbon layer can be formed of a polyamide insulating material, such as Kapton® from DuPont.

The stop members may be formed by merely thickening a portion (region) of the ribbon layer, in which case the required precision can already be produced in the casting or compression mold in the production of the ribbon layer.

The stop members may alternatively be composed of a different material from the ribbon layer such as ceramic or metal, in which case, given a corresponding shaping of a gluing mold, the desired precision can be achieved by the design of the gluing tool and variation of the thickness of the glue layer used to attach the stop members to the ribbon layer.

The recesses in the inkjet printer modules can be introduced during manufacture of the individual plates of the inkjet printer module, such as by laser etching or punching of the plates.

Since the ink-jet printer modules and the ribbon conductor ends lying therebetween are only stacked above one another and are then held together non-positively, an easy replacement of the modules becomes possible. Further, units that can be easily tested are also produced. This allows an effective testing during the manufacturing process, an increase in the yield rate of the ink-jet head manufacture and improved service. This is significant, particularly since ink-jet printer modules, with their many nozzle apertures, are still costly components.

The assembly and contacting of the piezoactuators is simplified due to the one-piece, chamber-like embodiment and extent of all electrodes into one plane. The manufacture of the piezocombs can ensue in a simple way such that the tooth structure is first sawed into a quadrangular block of piezomaterial. The piezocombs are then sawed off of the block in the form of wafers.

The contacting to the exposed ends of the terminal lines can ensue with a solder with a low melting point such as indium.

DESCRIPTION OF THE PREFERRED EMBODIMENTS

All of the Figures are schematically drawn to facilitate the illustration.

Figure 1:
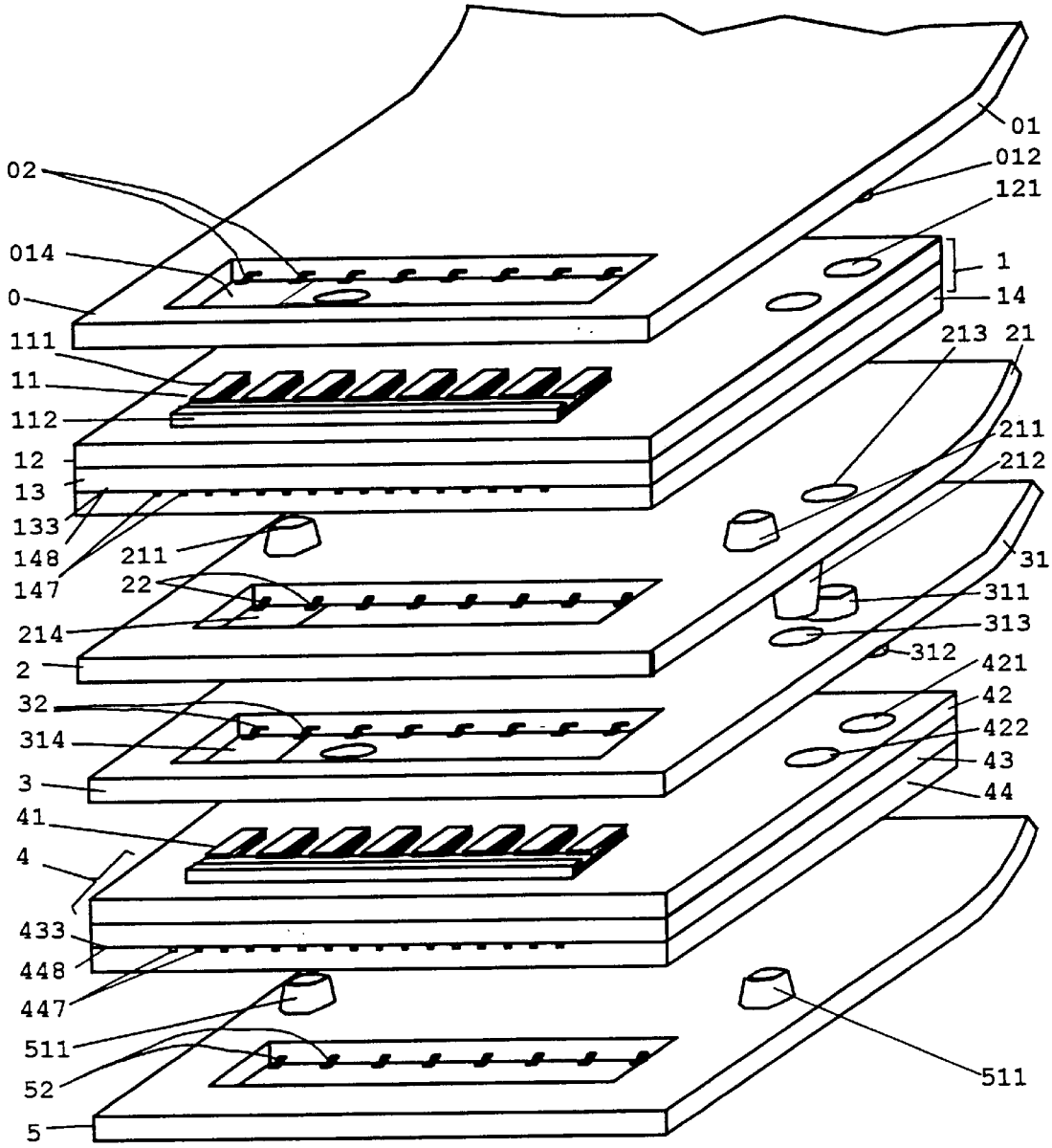
FIG. 1 is an exploded view of an ink-jet printer head composed of two inkjet printer modules constructed in accordance with the principles of the present invention.

According to FIG. 1, an ink-jet printer head is composed of two identical ink-jet printer modules 1 and 4 and four ribbon conductors 0, 2, 3 and 5 allocated thereto. Identical ones of these ribbon conductors are allocated to the same side of each ink-jet printer module.

The first ink-jet printer module 1 is assembled of a first cover plate 12, a middle plate 13 and a second cover plate 14. The plates can be connected to one another by gluing or thermal diffusion bonding.

Figure 3A:
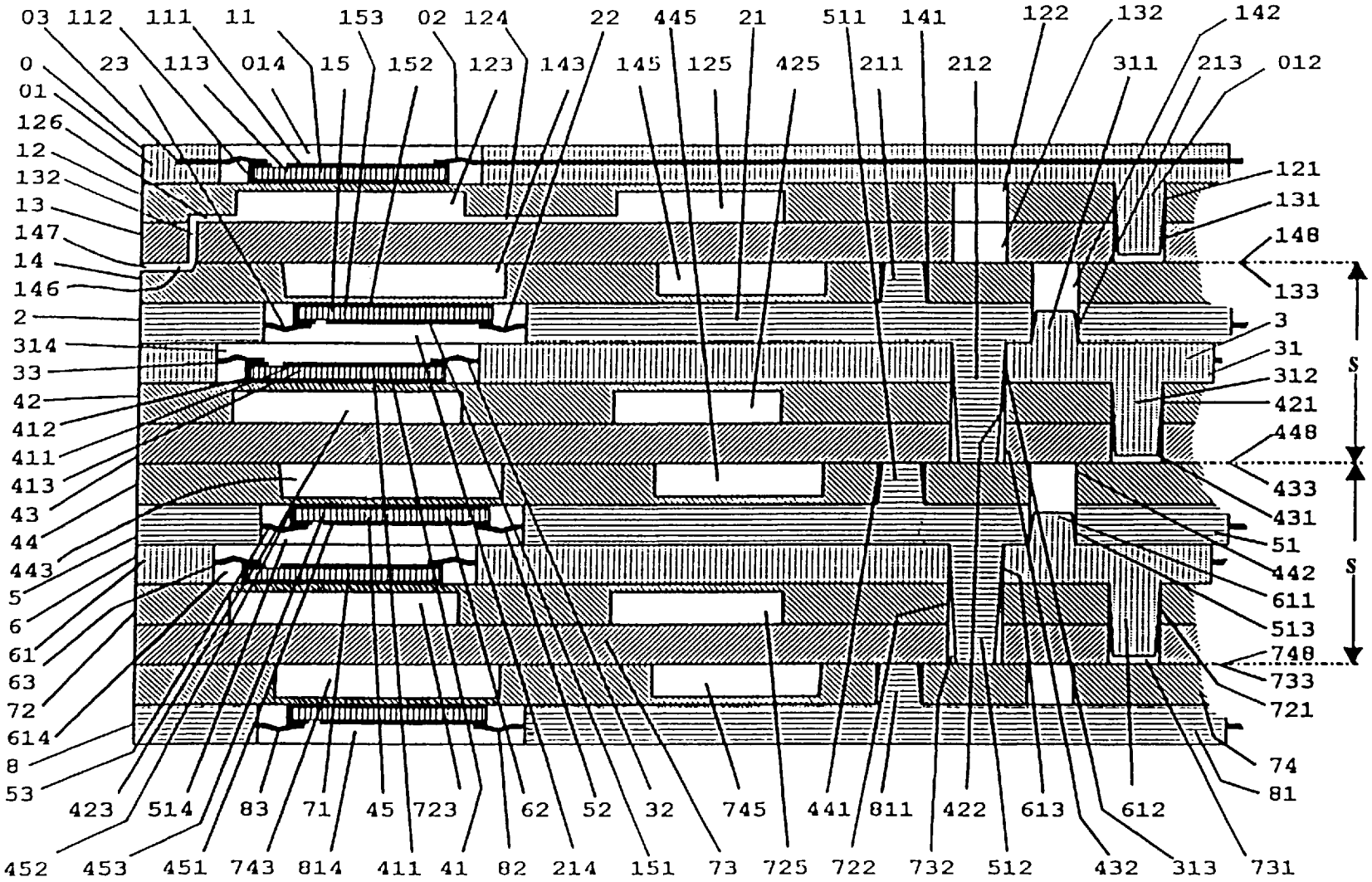
FIG. 3*a* is a view taken along section AA' of FIG. 2.
Figure 3B:
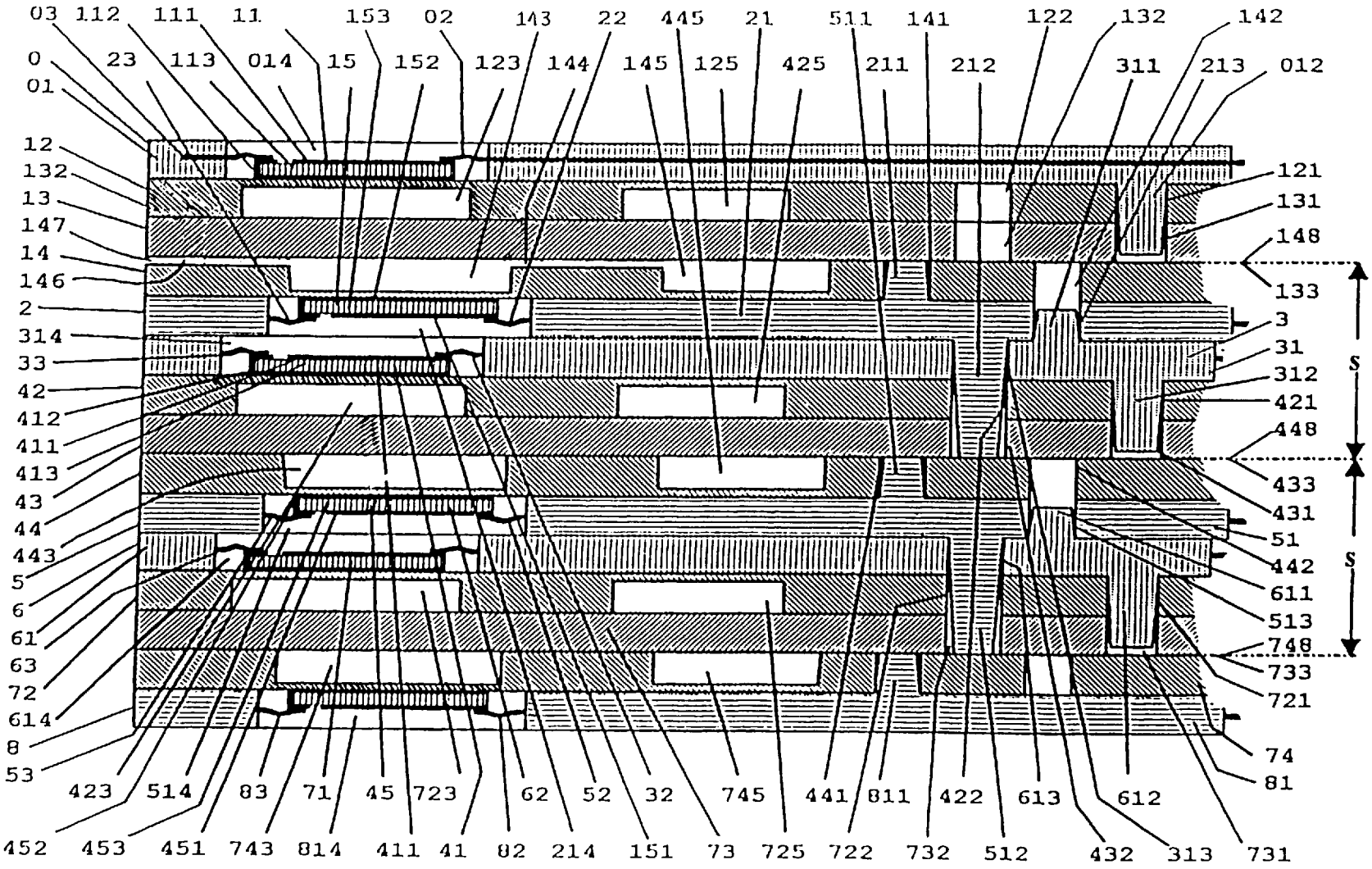
FIG. 3*b* is a view taken along section BB' of FIG. 2.

The respective surfaces of cover plates 12 and 14 facing toward the middle plate 13 are provided with ink pressure chambers 123, 143, ink channels 124, 144, nozzle channels 126, 146 and ink supply channels 125, 145, (also see FIGS. 3*a* and 3*b*).

All nozzle apertures 147 of the ink-jet printer module 1 proceed in a row in the second cover plate 14. To this end, the nozzle channels 126 are conducted from the first cover plate 12 through the middle plate 13 as nozzle channels 132 and are conducted further up to the nozzle channels 146 in the second cover plate 14, and terminate there as nozzle apertures 147. Sixteen nozzle apertures 147, 447 are provided in this case in each ink-jet printer module 1 and 4. A commercial ink-jet printer module, however, will have 64 nozzle apertures.

Respective piezoactuators 11 and 15, over every ink pressure chamber are put in place on the outside surfaces of the cover plates 12 and 14 in the region above the ink pressure chambers 123 and 143. The cover plates 12 and 14 are necessarily thinner in the regions above the ink pressure chambers 123 and 143 and act as a membrane at those regions. The designation membrane plate is therefore also applicable. Alternatively each cover plates may be a thin, smooth membrane plate and all structures are then disposed in the middle plate.

For facilitating manufacture, assembly and contacting, the piezoactuators 11 and 15 are implemented in the form of a comb whose spine is fashioned as an inactive region and whose tines are fashioned as active regions of piezolayers 113 and 153. Each tine represents an individual piezoactuator whose base and cover surface are occupied with electrodes 111, 112, 151, 152. One electrode 112, 152 extends over an end face (the comb spine) into the inactive region of the opposite side as a shared electrode of all piezoactuators 11 and 15. As a result, the contacting can ensue proceeding from one side. Since the piezoactuators 11 and 15 are united in a single component and are spaced from one another by the chamber spacing, a complicated individual attachment and alignment above the ink pressure chambers 123 and 143 is avoided.

The piezoactuator component can be glued on as a unit over previously applied registration marks.

Figure 5:
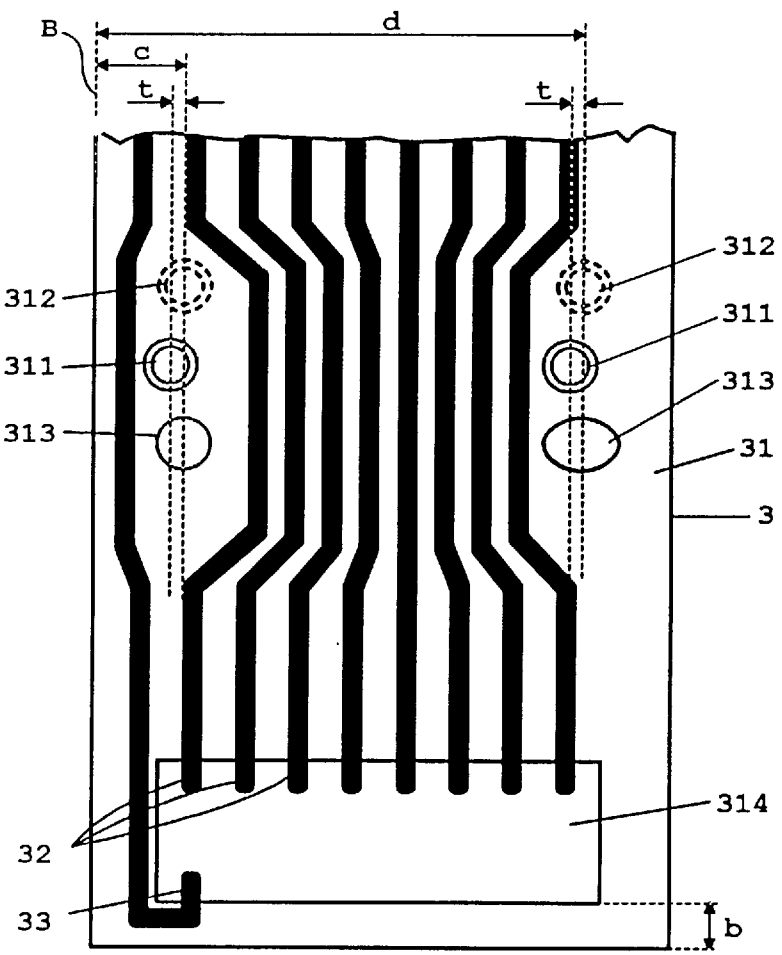
FIG. 5 is a plan view onto the other of the ribbon conductor in the region between the same two neighboring ink-jet printer modules.
Figure 4:
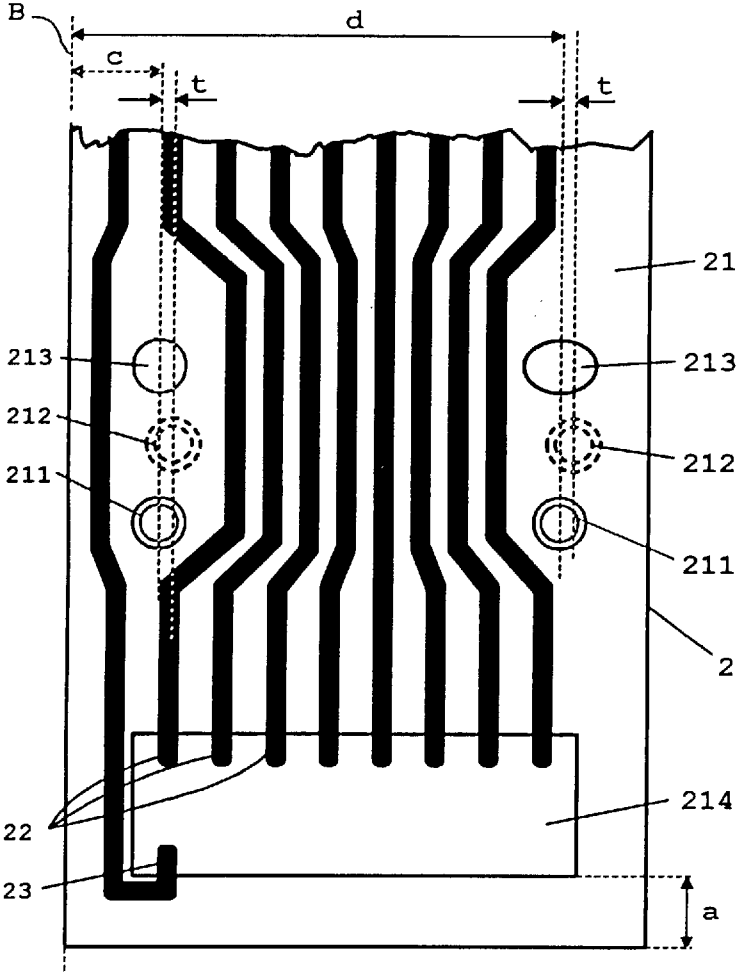
FIG. 4 a plan view onto one of the ribbon conductors in the region between two neighboring ink-jet printer modules.

The electrodes 111, 112, 151 and 152 are connected by a solder having a low melting point, such as indium, to allocated, bare leads 02, 03, 22, 23 of the ribbon conductors 0 and 2 (also see FIGS. 4 and 5).

The ribbon conductors 0 and 2 directly adjacent the ink-jet printer module 1 are fashioned so as to align with the first ink-jet printer module 1 (due to the fact that stop members and allocated recesses in the module are identically positioned with reference to a defined lateral edge B) and to produce an offset by the print density dimension t relative to the neighboring, second ink-jet printer module (also see FIGS. 2, 3*a*, 3*b*, 4 and 5). The thickness of the ribbon conductors 2 and 3 (with applied piezoactuators 15 and 41, respectively) as well as 5 and 6 (with applied piezoactuators 45 and 71, respectively) is dimensioned such that there is a sufficient spacing between the ink-jet printer modules 1 and 4 as well as between modules 4 and 7. The ribbon conductor 2 is provided with stop members 211 and 212 at both sides that engage into allocated, matched recesses 313 of the ribbon conductor 3 as well as into recesses 141, 422 and 432 of the ink-jet printer modules 1 and 4, (also see FIGS. 1, 3, 4 and 5).

Accordingly, the ribbon conductor 3 is provided with stop members 311 and 312 at both sides, these engaging into allocated, matched recesses 213 of the ribbon conductor 2 as well as into recesses 142, 421 and 431 of the ink-jet printer modules 1 and 4.

In the example, the ribbon conductors 2 and 3 each is shown as having two pairs of stop members 211, 212 and 311, 312 for a simpler illustration. In the practical realization, it is expedient to provide three pair of stop members. Correspondingly, two groups of the recesses would then be fashioned as oblong holes and one group of the recesses as cylindrical holes, see FIGS. 4 and 5.

The stop member 211 has an end surface pressing against the nozzle level 133 in the inkjet printer module 1. The stop member 212 has an end surface pressing against the nozzle level 448 in the ink-jet printer module 4. The parallel spacing of the cover surfaces of the oppositely directed stop members 211 and 212 of a ribbon conductor 2 is equal to the required spacing s of the nozzle levels 133 and 448 from one another. The plate thickness of the ribbon conductors 2 and 3, accordingly, is dimensioned such that the required spacing is defined exclusively by the stop members 211 and 212. For this reason, the stop members 311 and 312 of the ribbon conductor 3 in FIG. 3 are shorter than those of the ribbon conductor 2. In this case, they act as connector elements. If the stop members 311 and 312 were to have their end surfaces pressing against the allocated nozzle levels 133 and 448, then the stop members 211 and 212 would have to be shorter.

Compared to the stop member 212, the stop member 211 is shorter by the plate thickness of the ribbon conductor 3 and by a thickness of the middle plate since it only penetrates the cover plate 14 in the recess 141. The stop member 212 penetrates the ribbon conductor 3 in the recess 313, the cover plate 42 in the recess 422 and the middle plate 43 in the recess 432.

With reference to a defined side edge B of the ribbon conductors 2 and 3 and of the ink-jet printer module 4, the recesses 313, 422 and 432 are offset less by the print density dimension t, than the stop member 212 at the ribbon conductor 2. The spacing of the recesses 313, 422 and 432 relative to the side edge B amounts to the dimension c or d in this case. Correspondingly, the spacing of the stop members 212 is c+t or d+t. The spacing of the recesses 142, 213 from the side edge B amounts to c or d, and the spacing of the allocated stop member 313 is c−t or d−t. This applies analogously to all other ribbon conductors and modules.

In this way, the first nozzle aperture 447 of the second ink-jet printer module 4 is offset by the printing density dimension t relative to the first nozzle aperture 147 of the first ink-jet printer module 1 and the other nozzle apertures 447 are also correspondingly offset.

The ribbon conductor 0 is provided with a recess 014 for the piezoactuator 11. Its stop members 012 engage into allocated, matched recesses 121 and 131 of the inkjet printer module 1. The ribbon conductor 2 is provided with a recess 214 for the piezoactuator 15.

The ribbon conductor 3 is provided with a recess 314 for the piezoactuator 41.

Figure 2:
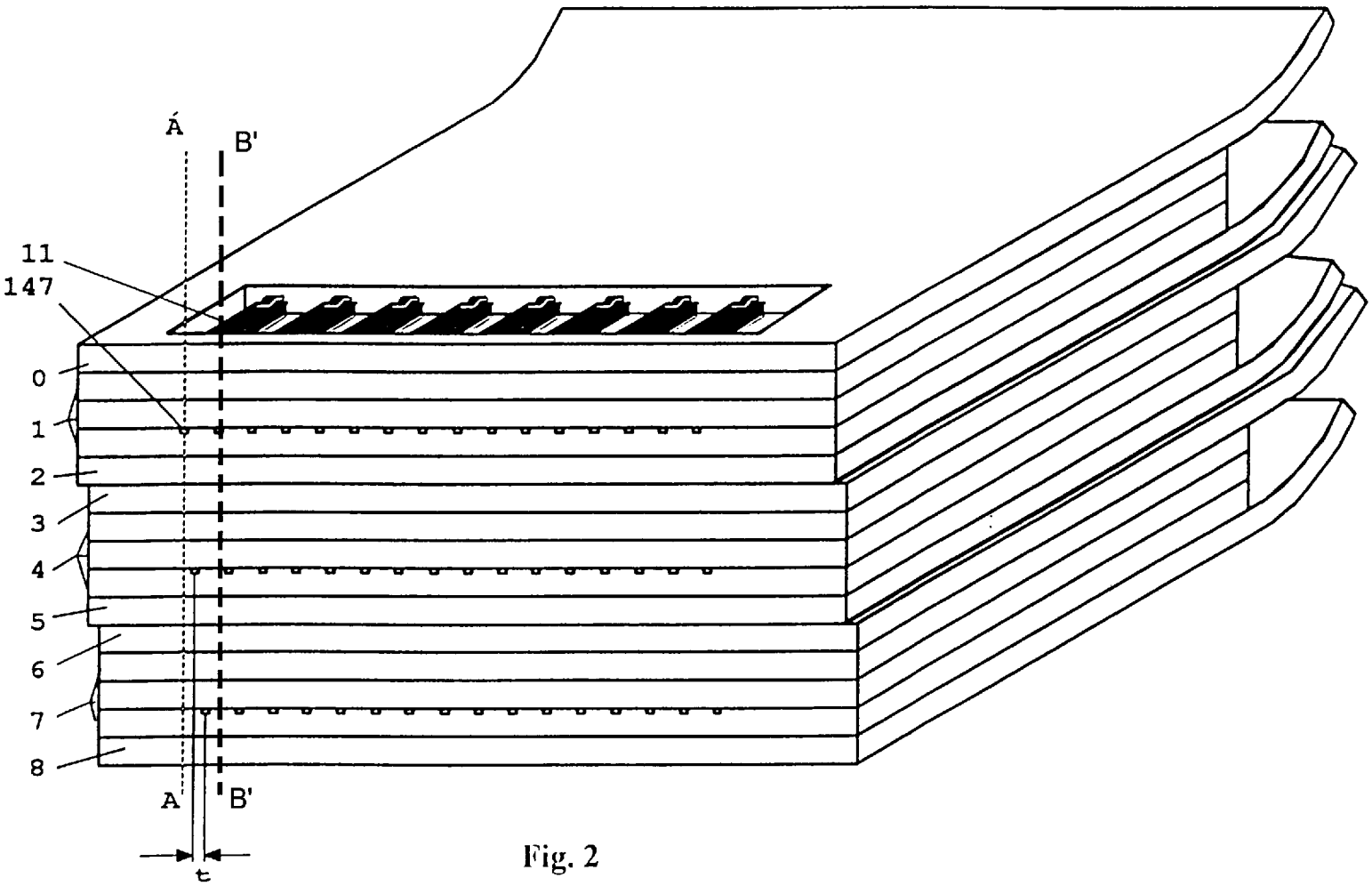
FIG. 2 is a perspective view of an ink-jet printer head assembled from three ink-jet printer modules constructed in accordance with the principles of the present invention.

Since the section AA' of FIG. 2 is placed through the outermost nozzle aperture 147 of the first ink-jet printer module 1 and the view is shown in the direction of the neighboring outside according to FIG. 3*a*, only the connections from the ink supply channel 125 via the ink channel 124 to the ink pressure chamber 123, the nozzle channel 126, the nozzle channel 132, the nozzle channel 146 up to the nozzle aperture 147 can be seen.

The ink supply channels 125 and 145 proceed orthogonally relative to the ink channels 124 and 144 and parallel to the nozzle apertures row 147.

Since all ink-jet printer modules 1, 4 and 7 are identically constructed and the ribbon conductors 2 and 5 as well as the ribbon conductors 3 and 6 are likewise identically constructed, a stacking of the ink-jet printer modules is possible in the desired way, with equidistance and side offset of the nozzle rows being assured.

The ribbon conductor 8 is provided with a recess 814 for the piezoactuator 75. Its stop members 811 engage into allocated recesses 741 of the third ink-jet printer module 7. The elements of these further components are the same as described above and are identified with reference numbers which are the same except for the first digit, which identifies the component to which the element is allocated.

Although modifications and changes may be suggested by those skilled in the art, it is the intention of the inventors to embody within the patent warranted hereon all changes and modifications as reasonably and properly come within the scope of their contribution to the art.

We claim as our invention:

1. An ink-jet printer head comprising:

a plurality of identical edge-shooter printer modules, each of said printer modules having a plurality of nozzles disposed in a nozzle row extending along a first direction and said printer modules being stacked along a second direction substantially perpendicular to said first direction to form a stack of successive printer modules, each of said printer modules having a plurality of piezoactuators respectively communicating with the nozzles in the nozzle row for ejecting ink out of the nozzles in the nozzle row; and a plurality of ribbon conductor means for supplying electrical signals to said piezoactuators, said plurality of ribbon conductor means disposed in said stack in alternation with said printer modules so that each printer module has at least a respective one of said plurality of ribbon conductor means being adjacent thereto and each of said ribbon conductor means comprising a plurality of electrical leads respectively connected to the piezo-actuators of the printer module adjacent thereto, and each of said ribbon conductor means comprising a ribbon layer surrounding the electrical leads therein, and at least one of said plurality of ribbon conductor means including at least one interior ribbon conductor layer disposed between two of said successive printer modules in said stack, the ribbon layer of said interior ribbon conductor layer comprising spacer means for setting a spacing between said two of said successive printer modules in said second direction and an offset between said two of said successive modules in said first direction to stagger the respective nozzle rows of said successive modules.

2. An ink-jet printer head as claimed in claim 1 wherein each of said two of said successive modules has a recess therein and wherein said spacer means comprises first and second stop members respectively disposed on opposite sides of said ribbon layer of said interior ribbon conductor layer, and respectively engaging said recesses in said two of said successive modules.

3. An ink-jet printer head as claimed in claim 2 wherein each of said first and second stop members has an end surface, the respective end surfaces of the stop members disposed on opposite sides of said ribbon layer of said interior ribbon conductor layer being spaced from each other by a spacing equal to the spacing in said second direction.

4. An ink-jet printer head as claimed in claim 2 wherein said stop members respectively comprise metal elements attached to said ribbon layer of said interior ribbon conductor layer.

5. An ink-jet printer head as claimed in claim 4 wherein said metal elements are glued to said ribbon layer of said interior ribbon conductor layer.

6. An ink-jet printer head as claimed in claim 2 wherein said stop members respectively comprise thickened portions of said ribbon layer of said interior ribbon conductor layer integrally formed with said ribbon layer.

7. An ink-jet printer head as claimed in claim 2 wherein said stop members respectively comprise ceramic material attached to said ribbon layer of said interior ribbon conductor layer.

8. An ink-jet printer head as claimed in claim 7 wherein said ceramic material is glued to said ribbon layer of said interior ribbon conductor layer.

9. An ink-jet printer head as claimed in claim 1 wherein said two of said successive modules comprise a first module of said plurality of printer modules and a second module of said plurality of printer modules and wherein said ribbon layer of said interior ribbon conductor layer has a side edge and comprises a first sub-layer and a second sub-layer, said first sub-layer being adjacent to and in registry with said first module and said second sub-layer being adjacent to and in registry with said second module, and wherein said spacer means comprises two stop members on said first sub-layer facing toward and engaging into said second sub-layer, said two stop members being spaced from said side edge of said ribbon layer by a distance for producing said offset in said first direction.

10. An ink-jet printer head as claimed in claim 9 wherein said ribbon layer of said interior ribbon conductor layer has a front edge and wherein said two stop members are equidistantly spaced from said front edge of said ribbon layer of said interior ribbon conductor layer and are equidistantly spaced from opposite side edges of said ribbon layer of said interior ribbon conductor layer in a direction parallel to said front edge.

11. An ink-jet printer head as claimed in claim 1 wherein said ribbon layer of each of said ribbon conductor means comprises a polyamide insulator.

12. An ink-jet printer head as claimed in claim 1 wherein said ribbon layer of each of said ribbon conductor means has a recess therein in registry with and receiving said piezoactuators of the printer module adjacent thereto.

13. An ink-jet printer head as claimed in claim 12 wherein said piezoactuators respectively have piezoactuator electrodes, and wherein said leads of each of said ribbon conductor means are exposed in said recess and respectively extend to and are connected to piezoactuator electrodes of said piezoactuators in said recess.

14. An ink-jet printer head as claimed in claim 13 wherein said leads are respectively connected to said piezoactuator electrodes with solder having a low melting point.

15. An ink-let printer head as claimed in claim 14 wherein said solder comprises indium solder.

16. An ink-jet printer head comprising:

a plurality of identical edge-shooter printer modules, each of said printer modules having a plurality of nozzles disposed in a nozzle row extending along a first direction and said printer modules being stacked along a second direction substantially perpendicular to said first direction to form a stack of successive printer modules, each of said printer modules having a plurality of piezoactuators respectively communicating with the nozzles in the nozzle row for ejecting ink out of the nozzles of the nozzle row; and a plurality of ribbon conductor means for supplying electrical signals to said piezoactuators, said plurality of ribbon conductor means being disposed in said stack in alternation with said printer modules so that each printer module has at least a respective one of said plurality ribbon conductor means adjacent thereto and each of said ribbon conductor means comprising a plurality of electrical leads respectively connected to the piezo-actuators of the printer modules adjacent thereto, and each of said ribbon conductor means comprising a ribbon layer surrounding the electrical leads therein, and at least one of said plurality of ribbon conductor means including at least one interior ribbon conductor layer disposed between two of said successive printer modules in said stack, the ribbon layer of said interior ribbon conductor layer comprising spacer means for setting a spacing between said two of said successive modules in said second direction.

17. An ink-jet printer head as claimed in claim 16 wherein each of said two of said successive modules has a recess therein and wherein said spacer means comprises first and second stop members respectively disposed on opposite sides of said ribbon layer of said interior ribbon conductor layer, and respectively engaging said recesses in said two of said successive modules.

18. An ink-jet printer head as claimed in claim 17 wherein of said first and second each stop members has an end surface, the respective end surfaces of said first and second stop members disposed on opposite sides of said ribbon layer of said interior ribbon conductor layer being spaced from each other by a spacing equal to the spacing in said second direction.

19. An ink-jet printer head as claimed in claim 17 wherein said stop members respectively comprise thickened portions of said ribbon layer of said interior ribbon conductor layer integrally formed with said ribbon layer of said interior ribbon conductor layer.

20. An ink-jet printer head as claimed in claim 17 wherein said stop members respectively comprise ceramic material attached to the ribbon layer of said interior ribbon conductor layer.

21. An ink-jet printer head as claimed in claim 20 wherein said ceramic material is glued to said ribbon layer of said interior ribbon conductor layer.

22. An ink-jet printer head as claimed in claim 17 wherein said stop members respectively comprise metal elements attached to said ribbon layer of said interior ribbon conductor layer.

23. An ink-jet printer head as claimed in claim 22 wherein said metal elements are glued to said ribbon layer of said interior ribbon conductor layer.

24. An ink-jet printer head as claimed in claim 16 wherein said ribbon layer in each of said ribbon conductor means comprises a polyamide insulator.

25. An ink-jet printer head as claimed in claim 16 wherein said ribbon layer of said ribbon conductor means has a recess therein in registry with and receiving said piezoactuators of the printer module adjacent thereto.

26. An ink-jet printer head as claimed in claim 25 wherein said piezoactuators respectively have piezoactuator electrodes, and wherein said leads of each of said ribbon conductor means are exposed in said recess and respectively extend to and are connected to piezoactuator electrodes of said piezoactuators in said recess.

27. An ink-jet printer head as claimed in claim 26 wherein said leads are respectively connected to said piezoactuator electrodes with solder having a low melting point.

28. An ink-jet printer head as claimed in claim 27 wherein said solder comprises indium solder.

29. An ink-jet printer head comprising:

a plurality of identical edge-shooter printer modules, each of said printer modules having a plurality of nozzles disposed in a nozzle row extending along a first direction and said printer modules being stacked along a second direction substantially perpendicular to said first direction to form a stack of successive printer modules, each of said printer modules having a plurality of piezoactuators communicating with the nozzles in the nozzle row for ejecting ink out of the nozzles of the nozzle row; and a plurality of ribbon conductor means for supplying electrical signals to said piezoactuators, said plurality of ribbon conductor means being disposed in said stack in alternation with said printer modules so that each printer module has at least a respective one of said plurality of ribbon conductor means adjacent thereto and each of said ribbon conductor means comprising a plurality of electrical leads respectively connected to the piezo-actuators of the printer module adjacent thereto, and each of said ribbon conductor means comprising a ribbon layer surrounding the electrical leads therein, and at least one of said plurality of ribbon conductor means including at least one interior ribbon conductor layer disposed between two of said successive printer modules in said stack, the ribbon layer of said interior ribbon conductor layer comprising spacer means for fixing an offset between said two of said successive modules in said first direction for staggering the respective nozzle rows of said two of said successive modules.

30. An ink-jet printer head as claimed in claim 29 wherein each of said two of said successive modules as a recess and wherein said spacer means comprises first and second stop members disposed on opposite sides of said ribbon layer of said interior ribbon conductor layer, and respectively engaging said recesses in said two of said successive modules.

31. An ink-jet printer head as claimed in claim 30 wherein said two of said successive modules comprise a first module of said plurality of printer modules and a second module of said plurality of printer modules and wherein said ribbon layer of said interior ribbon conductor layer, has a side edge and comprises a first sub-layer and a second sub-layer, said first sub-layer being adjacent to and in registry with said first module and said second sub-layer being adjacent to and in registry with said second module, and wherein said spacer means comprises two stop members on said first sub-layer facing toward and engaging into said second sub-layer, said two stop members being spaced from said side edge of said ribbon layer of said interior ribbon conductor layer by a distance for producing said offset in said first direction.

32. An ink-jet printer head as claimed in claim 31 wherein ribbon layer of said interior ribbon conductor layer has a front edge and wherein said two stop members are equidistantly spaced from said front edge of said ribbon layer of said interior ribbon conductor means and are equidistantly spaced from opposite side edges of said ribbon layer of said interior ribbon conductor layer in a direction parallel to said front edge.

33. An ink-jet printer head as claimed in claim 30 wherein said stop members respectively comprise thickened portions of said ribbon layer of said interior ribbon conductor layer integrally formed with said ribbon layer of said interior ribbon conductor layer.

34. An ink-jet printer head as claimed in claim 30 wherein said stop members respectively comprise ceramic material attached to said ribbon layer of said interior ribbon conductor layer.

35. An ink-jet printer head as claimed in claim 34 wherein said ceramic material is glued to said ribbon layer of said interior ribbon conductor layer.

36. An ink-jet printer head as claimed in claim 30 wherein said stop members respectively comprise metal elements attached to said ribbon layer of said interior ribbon conductor layer.

37. An ink-jet printer head as claimed in claim 36 wherein said metal elements are glued to said ribbon layer of said interior ribbon conductor layer.

38. An ink-jet printer head as claimed in claim 29 wherein said ribbon layer of said ribbon conductor means comprises a polyamide insulator.

39. An ink-jet printer head as claimed in claim 29 wherein said ribbon layer in each of said ribbon conductor means has a recess therein in registry with and receiving said piezoactuators of the printer module adjacent thereto.

40. An ink-jet printer head as claimed in claim 39 wherein said piezoactuators respectively have piezoactuator electrodes, and wherein said leads of each of said ribbon conductor means are exposed in said recess and respectively extend to and are connected to piezoactuator electrodes of said piezoactuators in said recess.

41. An ink-jet printer head as claimed in claim 40 wherein said leads are respectively connected to said piezoactuator electrodes with solder having a low melting point.

42. An ink-jet printer head as claimed in claim 41 wherein said solder comprises indium solder.

* * * * *